US009874025B2

(12) United States Patent
Park

(10) Patent No.: US 9,874,025 B2
(45) Date of Patent: Jan. 23, 2018

(54) SHEET FIXING FRAME

(71) Applicant: SSILING TECH CO., LTD., Seoul (KR)

(72) Inventor: Hyun Yong Park, Seoul (KR)

(73) Assignee: SSILING TECH CO., LTD., Seoul (KR)

( * ) Notice: Subject to any disclaimer, the term of this patent is extended or adjusted under 35 U.S.C. 154(b) by 1342 days.

(21) Appl. No.: 13/823,910

(22) PCT Filed: Jan. 25, 2013

(86) PCT No.: PCT/KR2013/000612
§ 371 (c)(1),
(2) Date: Mar. 15, 2013

(87) PCT Pub. No.: WO2013/111991
PCT Pub. Date: Aug. 1, 2013

(65) Prior Publication Data

US 2017/0198480 A1 Jul. 13, 2017

(30) Foreign Application Priority Data

Jan. 25, 2012 (KR) ..... 10-2012-0007147
Apr. 17, 2012 (KR) ..... 10-2012-0039770

(51) Int. Cl.
*E04F 13/00* (2006.01)
*E04B 9/30* (2006.01)
(Continued)

(52) U.S. Cl.
CPC ..... *E04F 13/005* (2013.01); *E04B 9/303* (2013.01); *F21S 8/02* (2013.01); *F21V 17/00* (2013.01); *E04B 2009/0492* (2013.01)

(58) Field of Classification Search
CPC . E04B 9/245; E04B 9/303; E04B 9/04; E04B 9/06; E04F 13/005
See application file for complete search history.

(56) References Cited

U.S. PATENT DOCUMENTS 4,189,880 A * 2/1980 Ballin ..... E06B 3/285 160/380
4,631,882 A * 12/1986 Sease ..... H01B 13/012 160/395

(Continued)

OTHER PUBLICATIONS

Abstract of European Patent—EP0136954(A2), Apr. 20, 1985, 2 pages.

(Continued)

*Primary Examiner* — Paola Agudelo
(74) *Attorney, Agent, or Firm* — Dority & Manning, P.A.

(57) ABSTRACT

Provided herein is a sheet fixing frame, which is installed on a periphery of an installation subject and secures an end of a cover sheet for finishing an installation subject area, the sheet fixing frame including a fixing frame which has a fixing plate contacting the installation subject area, a fixing hook which is bent in one end of the fixing plate and to which an end of the cover sheet is coupled, and a supporting plate which is bent in a direction parallel to the fixing hook in another end of the fixing plate so as to provide a receiving space between the fixing hook and supports the cover sheet, wherein the fixing frame is placed on the periphery of the installation subject area; a fastening member which penetrates the fixing plate between the fixing hook and the supporting plate and is fastened to the installation subject area; and a supporting member which has a coupling to which the supporting plate of the fixing frame is inserted at its one end, and a supporter which supports the cover sheet at its another end.

9 Claims, 7 Drawing Sheets

(51) Int. Cl.

| | |
|---|---|
| ***F21V 17/00*** | (2006.01) |
| ***F21S 8/02*** | (2006.01) |
| *E04B 9/04* | (2006.01) |

(56) References Cited

U.S. PATENT DOCUMENTS 4,640,064 A * 2/1987 Goodworth, II ..... E04B 9/001 52/506.08
4,907,637 A * 3/1990 Hintsa ..... B44C 7/022 160/327
4,920,714 A * 5/1990 Sease ..... B44C 7/022 160/392
5,029,422 A * 7/1991 Scherrer ..... B44C 7/022 160/392
6,283,456 B1 * 9/2001 Benz ..... E04H 17/163 160/391
7,096,633 B1 * 8/2006 Bowen ..... E04B 9/064 52/476
2004/0244318 A1 * 12/2004 Furr ..... G09F 7/18 52/311.1
2005/0150616 A1 * 7/2005 McConnell ..... E04B 2/7422 160/368.1
2009/0103314 A1 * 4/2009 Hammer ..... E04B 9/303 362/351
2011/0061320 A1 * 3/2011 Scherrer ..... E04F 13/005 52/222

OTHER PUBLICATIONS

Abstract of Japanese Patent—JP3054815, Dec. 18, 1998, 1 page.
Abstract of Korean Patent—KR20-0393007, Aug. 17, 2005, 1 page.
Abstract of Korean Patent—KR20-0450381, Sep. 29, 2010, 1 page.
Abstract of Korean Patent—KR20-0455015, Aug. 10, 2011, 1 page.
Abstract of French Patent—FR2843141 A1, Feb. 6, 2004, 1 page.
Abstract of Korean Patent—KR20110084722A, Jul. 26, 2011, 1 page.
European Search Report, dated Dec. 4, 2015, 8 pages.

* cited by examiner

[Fig. 1]
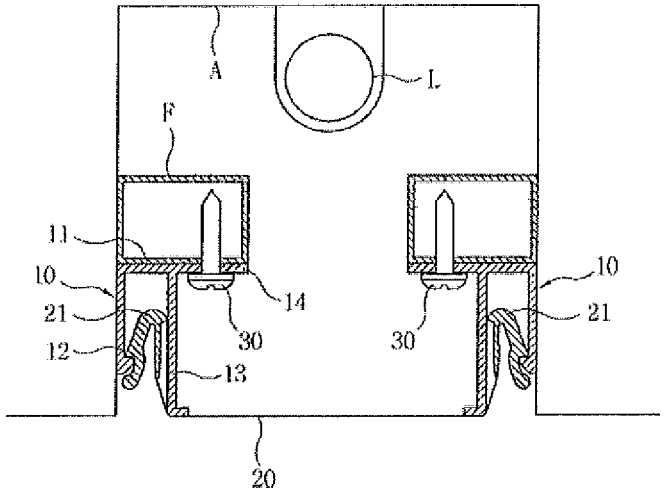
[Fig. 2]
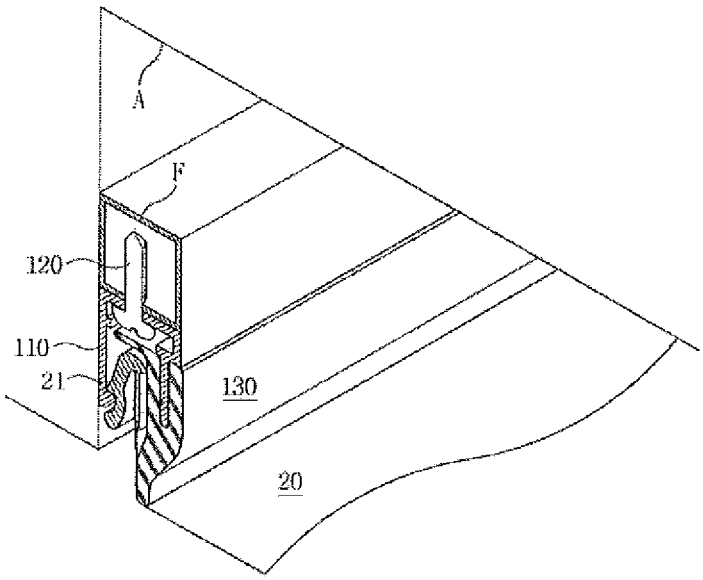

[Fig. 3]
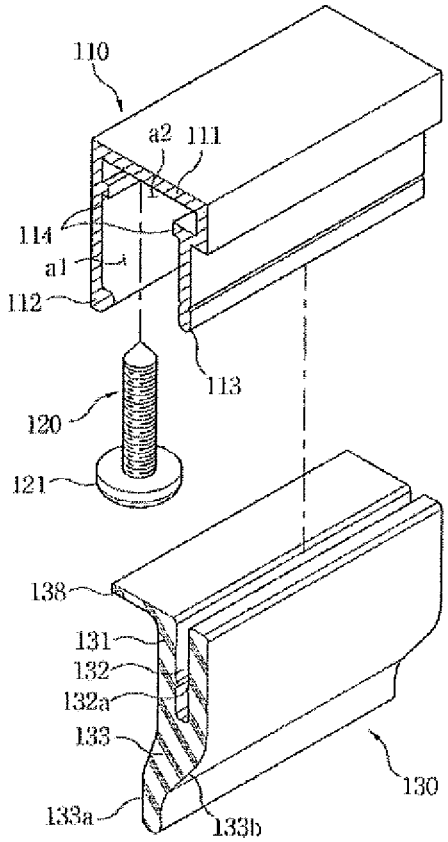
[Fig. 4]
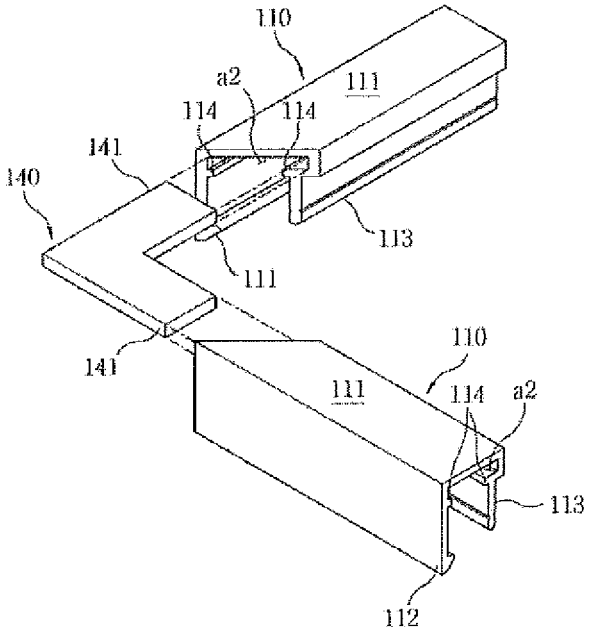

[Fig. 5]
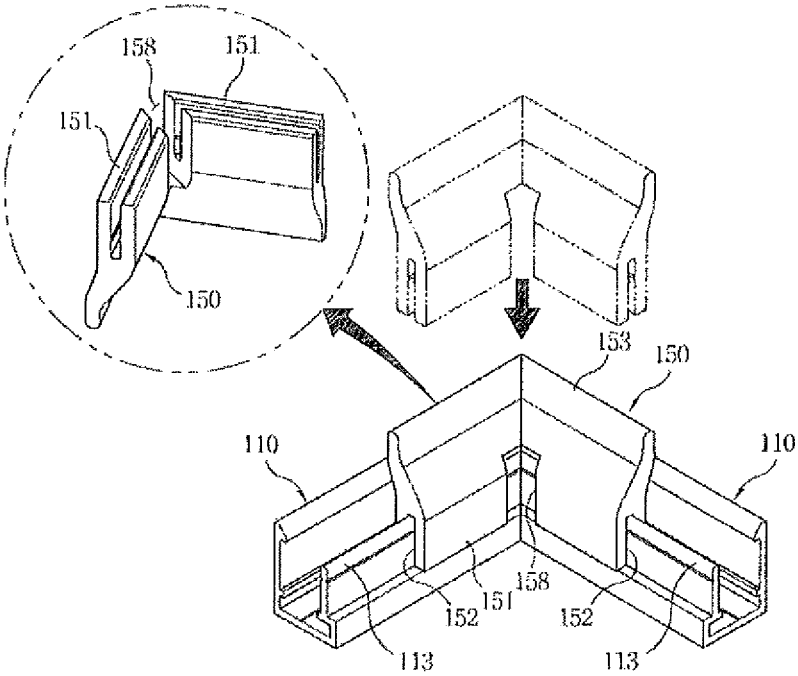
[Fig. 6]
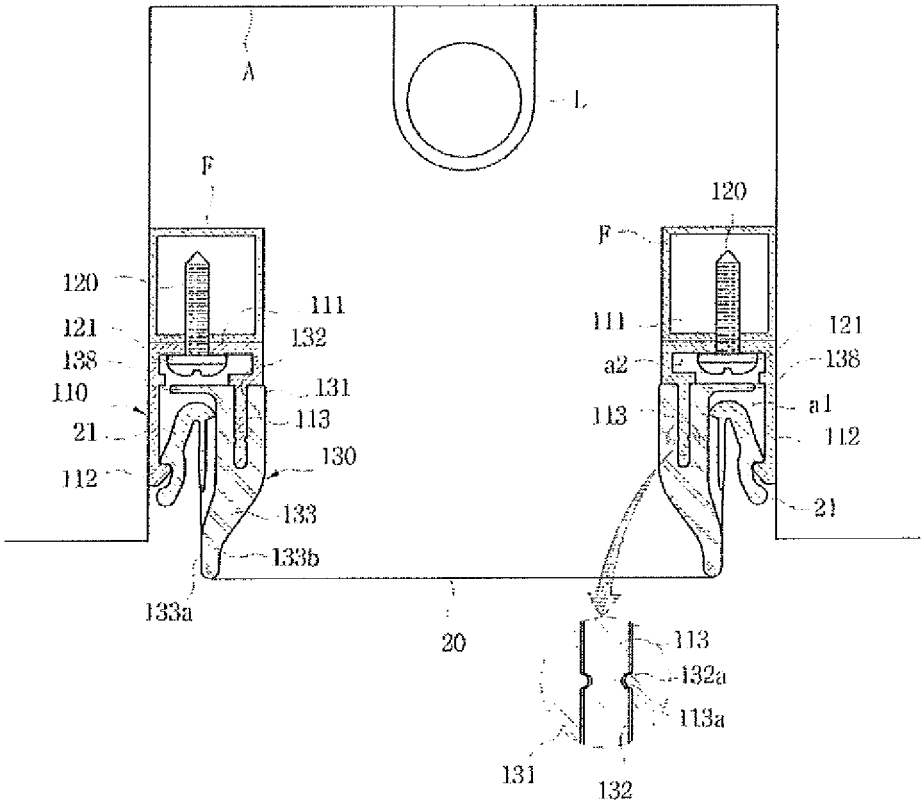

[Fig. 7]
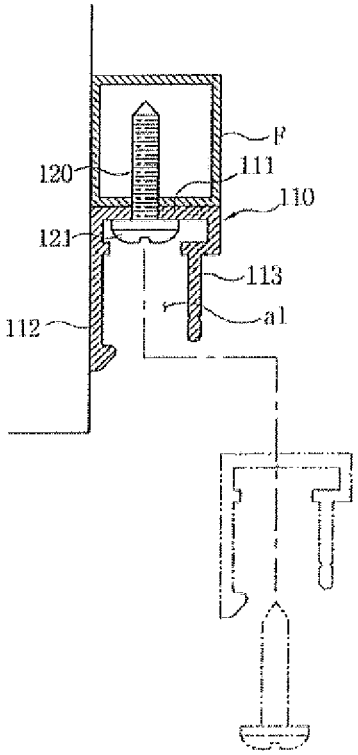
[Fig. 8]
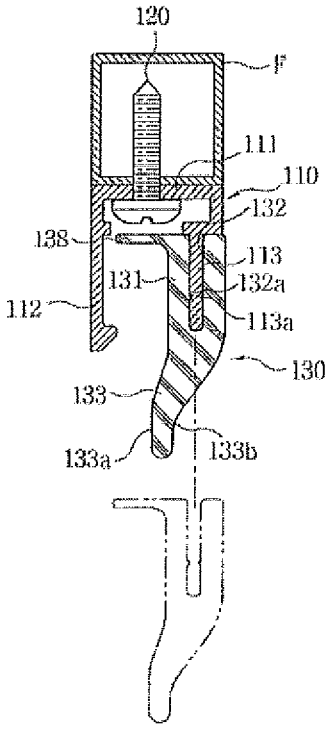

[Fig. 9]
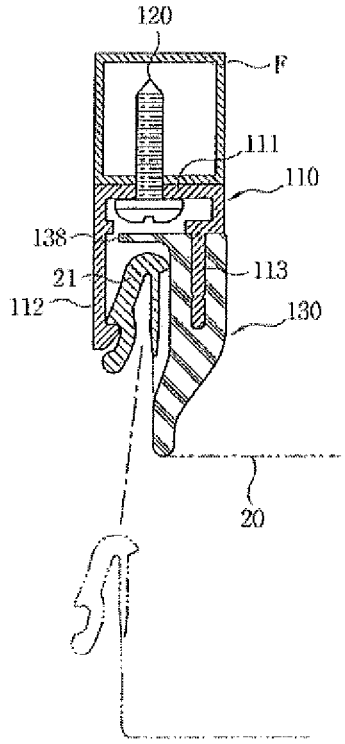
[Fig. 10]
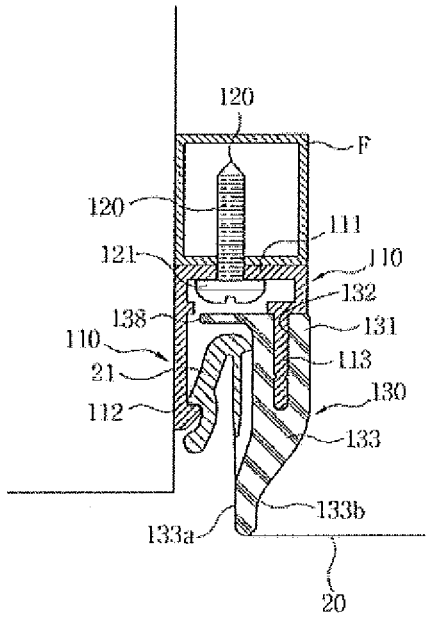

[Fig. 11]
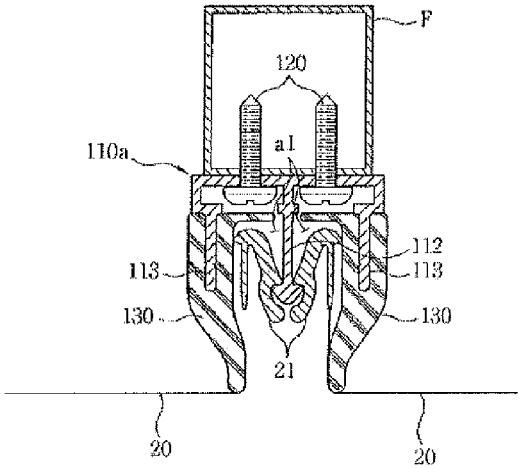
[Fig. 12]
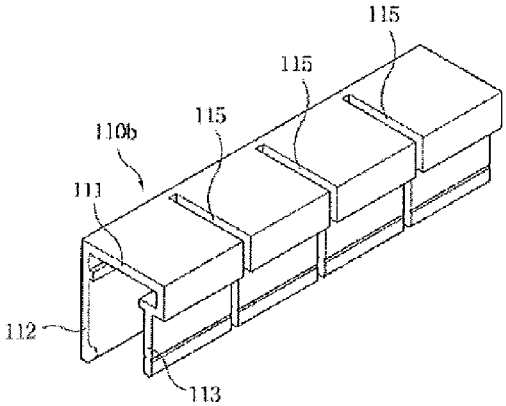
[Fig. 13]
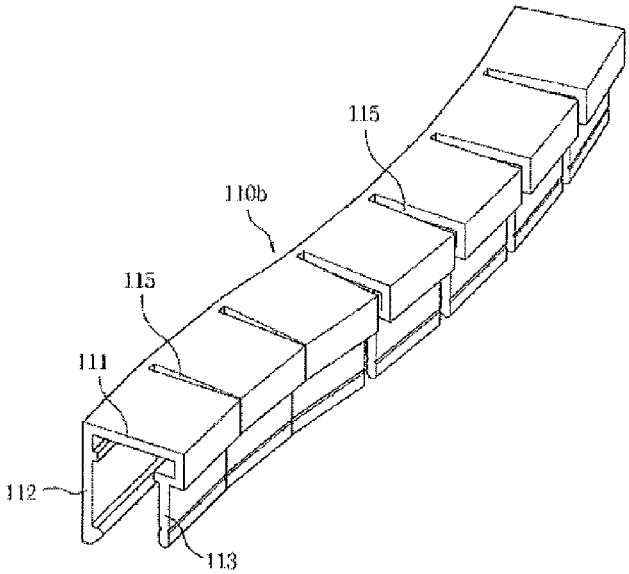

[Fig. 14]
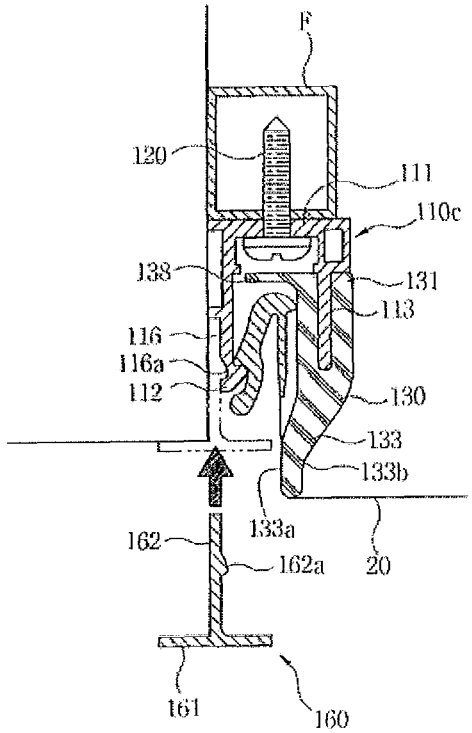
[Fig. 15]
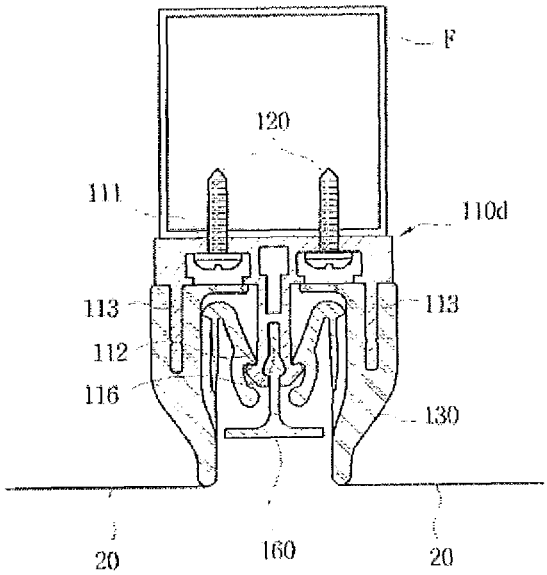

SHEET FIXING FRAME

CROSS REFERENCE TO RELATED APPLICATION

This application is the national stage entry of International Patent Application No. PCT/KR2013/000612 having a filing date of Jan. 25, 2013, which claims priority to and the benefit of Korean Patent Application No. 10-2012-0007147 filed in the Korean Intellectual Property Office on Jan. 25, 2012 and Korean Patent Application No. 10-2012-0039770 filed in the Korean Intellectual Property Office on Apr. 17, 2012, the entire contents of which are incorporated herein by reference.

BACKGROUND

1. Field

The following description relates to a sheet fixing frame, and more particularly, to a sheet fixing frame which is installed onto an installation subject area such as a ceiling or a wall in order to secure an end of a cover sheet thereby enabling the installation subject area to be finished by the cover sheet.

2. Description of Related Art

In general, a cover sheet is building interior material which is made by heating a sheet made of material having excellent elasticity and stability, such as polyvinyl chloride etc., stretching out the heated sheet, and then installing the sheet onto an installation subject area such as a ceiling or wall of a building, so as to improve the aesthetic appearance.

Such a cover sheet has excellent insulation, noncorrosive, flame resistant, waterproof, and moisture-free characteristics, and is also recyclable, and is thus environmentally friendly and widely used in France, German, and Italy etc.

A brief explanation on a construction method of such a cover sheet is given below.

First of all, a fixing frame is installed onto a top end of each wall surface which is connected to a ceiling surface of a building, so as to predetermine an installation subject area.

Next, a cover sheet which is cut to have a slightly smaller area than a total area of the ceiling surface and to which a fastening device is attached in each edge thereof is heated by a heating fan and is thus softened. A fastening device of a portion is then coupled to a fixing frame using a construction spatula, and while stretching out the cover sheet, the fastening device of the portion opposite to the aforementioned coupled portion is coupled to the fixing frame on the opposite side.

Next, fixing frames and fastening devices are coupled to each other as the construction spatula is moved from each portion where coupling has already been made to portions where coupling has yet to be made, thereby finishing the installation subject area with the cover sheet tautly stretched out.

A stretchable cover sheet which is constructed as aforementioned has a functionality of being constructed independently regardless of any other process and aesthetics of satisfying the needs of residents, and may thus be utilized in various forms such as in exhibition halls, hospitals, sports centers, and villas etc.

A fixing frame for securing the cover sheet enables a fastening device provided in an end portion of the cover sheet to be coupled thereto in a state where it is secured to a periphery of the installation subject area. Herein, in order to install such a fixing frame onto the wall surface, a tool such as a drill for securing a fastening element such as a screw must be placed in a side direction of the fixing frame, and thus there lies a problem that if the installation subject area is narrow, it is impossible to construct the structure. Therefore, in cases where the width of the installation subject area is narrow, methods of securing the fixing frame to the ceiling surface have been used.

Of the attached figures, FIG. 1 is a cross-sectional view illustrating a coupling state of a cover sheet installation structure of a building according to prior art.

As illustrated, in a general cover sheet installation structure, a fixing frame 10 is installed onto a ceiling surface of a building by a screw 30, and a fastening device 21 of a cover sheet 20 is coupled to a receiving space provided between a fixing hook 12 and a supporting plate 13.

However, since there is no space in the receiving space between the fixing hook 12 and supporting plate 13 for the screw 30 to be inserted, in order to have the fixing frame 10 be installed by the screw 30, an extension 14 is formed on one side of a fixing plate 11, and the extension is either directly secured to the installation subject area A or to an angle frame F which has been preinstalled onto the installation subject area A, using the screw 30.

However, as illustrated, in order to secure the fixing frame 10, the extension 14 reduces an area where the light from light source passes, thereby decreasing the light usage efficiency, which is a problem.

Therefore, when an extension 14 is formed to secure the fixing frame 10 to the installation subject area A having a narrow width, the width of the fixing frame 10 would increase, and thus there lies a problem that it becomes difficult to apply the cover sheet 20 to where a width of the installation subject area A is narrow such as in a concave space.

Furthermore, the supporting plate 13 which supports the cover sheet 20 and the fixing hook 12 which secures the fastening device 21 of the cover sheet 20 are placed together on one side of the extension 14 which is secured onto the installation subject area A, and thus there lies a problem that as the load placed on the supporting plate 13 and the load placed on the fixing hook 12 is concentrated between the fixing plate 11 and the extension 14 based on the extension 14 where fixation power by the screw 30 is applied, the fixing frame 10 is easily deformed, deteriorating the quality of the finishing.

SUMMARY OF THE INVENTION

Therefore, the purpose of the present invention is to resolve the aforementioned problems, and more particularly, to enable a fastening member to penetrate a fixing plate provided between a fixing hook of a fixing frame and a supporting plate and be secured to the installation subject area, thereby minimizing an area for installing the fixing frame compared to prior art and thus becoming able to install the fixing frame even in a narrow concave space and to provide a sheet fixing frame which may extend a scope of application of the cover sheet.

In addition, since the area for installing the fixing frame is minimized, a passage from light source towards the cover sheet is expanded, thereby providing a sheet fixing frame which may obtain more volume of light than prior art.

Furthermore, to the fixing plate located between the supporting plate and the fixing hook, a force for securing the fixing frame is applied, while to the supporting plate, a force supporting the cover sheet is applied, and thus load is concentrated on one area of the fixing frame, thereby not only preventing deformation of the fixing frame but also providing a sheet fixing frame which may exert stable supporting power.

Furthermore, as the cover sheet is made of transparent material and the supporting member is made of light diffusion material, both the front surface and side surface provide illumination light, thereby not only obtaining additional volume of light but also providing new visual effects different from conventional transparent finishing sheets such as preventing the portions where the fastening device is inserted from appearing in dark lines.

In addition, the purpose of the present invention is to provide a sheet fixing frame where an opening of a space where the fastening device is inserted is finished by a finishing member so as to prevent exposure of a handle portion of the fastening device and the portion connecting the junction and cover sheet, thereby improving the quality of the product.

In one general aspect, there is provided a sheet fixing frame which is installed on a periphery of an installation subject and secures an end of a cover sheet for finishing an installation subject area, the sheet fixing frame including a fixing frame which has a fixing plate contacting the installation subject area, a fixing hook which is bent in one end of the fixing plate and to which an end of the cover sheet is coupled, and a supporting plate which is bent in a direction parallel to the fixing hook in another end of the fixing plate so as to provide a receiving space between the fixing hook and supports the cover sheet, wherein the fixing frame is placed on the periphery of the installation subject area; a fastening member which penetrates the fixing plate between the fixing hook and the supporting plate and is fastened to the installation subject area; and a supporting member which has a coupling to which the supporting plate of the fixing frame is inserted at its one end, and a supporter which supports the cover sheet at its another end.

Herein, it is desirable that a width of the receiving space between the fixing hook and the supporting plate is extended and formed such that the fastening member can be inserted, the fastening member penetrates the fixing plate and is fastened to the installation subject area, and the width of the receiving space is reduced by the supporting member coupled to the supporting plate.

In addition, it is desirable that a fastening device which is inserted into a space between the supporting plate and the fixing hook and is secured to the fixing hook in a detachable manner is provided at an end of the cover sheet.

In addition, it is desirable that the supporting member is formed to protrude from a side of the coupling facing the receiving space, and comprises a dividing wall which divides the receiving space into a first space where the fastening device is placed and a second space where a head of the fastening member is placed.

In addition, it is desirable that a first bump and a first concave groove which engages each other are formed on a coupling surface of the supporting plate of the fixing frame and the coupling of the supporting member, respectively.

In addition, it is desirable that there are at least two fixing frames of which each end is connected to be installed on a periphery of the installation subject area.

In addition, it is desirable to further include a connecting bridge of which both ends are respectively inserted into each end of a pair of fixing frames placed adjacently to connect the pair of fixing frames.

In addition, it is desirable that a guide which is distanced from the fixing plate in the receiving place between the fixing hook and the supporting plate and secures an end of the connecting bridge is formed in the fixing frame.

In addition, it is desirable that the connecting member is placed on a connecting portion of a corner of the fixing frame, and has a central portion which is bent by an angle corresponding to an angle between the fixing frames of both sides.

In addition, it is desirable that light source is installed on the installation subject surface, and the cover sheet and the supporting member are made of transparent material.

In addition, it is desirable that the supporting member has, in a lower end of the supporter which faces the fixing hook, a supporting surface which supports the cover sheet at one side, and a dent at another side of the lower end.

In addition, it is desirable that a plurality of slits which cut the fixing plate and the supporting plate are formed in a direction intersecting with a longitudinal direction.

In addition, it is desirable to further include a finishing member which is secured to the fixing frame so as to finish an opening of an insertion side of the fastening device.

In addition, it is desirable that the finishing member has a finishing plate which is placed on an opening and an insertion plate which is protruded from an inner surface of the finishing plate, and the fixing frame has an insertion groove where the insertion plate is secured to the fixing hook.

In addition, it is desirable that a second concave groove and a second bump are formed on a coupling surface of the insertion plate and the insertion groove, respectively.

According to the present invention, a fastening member penetrates a fixing plate provided between a fixing hook of a fixing frame and a supporting plate and is secured to the installation subject area, thereby minimizing an area for installing the fixing frame compared to prior art and thus becomes able to install the fixing frame even in a narrow concave space and provide a sheet fixing frame which may extend a scope of application of the cover sheet.

In addition, since the area for installing the fixing frame is minimized, a passage from light source to the cover sheet is expanded, thereby providing a sheet fixing frame which may obtain more volume of light than prior art.

Furthermore, to the fixing plate placed between the supporting plate and fixing hook, a force for securing the fixing frame is applied, while to the supporting plate, a force supporting the cover sheet is applied, and thus load is concentrated on one area of the fixing frame, thereby not only preventing deformation of the fixing frame but also providing a sheet fixing frame which may exert stable supporting power.

Furthermore, as the cover sheet is made of transparent material and the supporting member is made of light diffusion material, both the front surface and side surface provide illumination light, thereby not only obtaining additional volume of light but also providing new visual effects different from conventional transparent finishing sheets such as preventing the portions where the fastening device is inserted from appearing in dark lines.

In addition, a sheet fixing frame is provided where an opening of a space where a fastening device is inserted is finished by a finishing member so as to prevent exposure of a handle of the fastening device and the portion connecting the fastening device and cover sheet, thereby improving the quality of the product.

BRIEF DESCRIPTION OF THE DRAWINGS

FIG. 1 is a cross-sectional view illustrating a coupling state of a cover sheet installation structure in a building according to prior art;

FIG. 2 is a perspective view of a sheet fixing frame of the present invention;

FIG. 3 is an exploded perspective view of a sheet fixing frame of the present invention;

FIG. 4 is a perspective view of a connecting portion of a corner of a sheet fixing frame of the present invention;

FIG. 5 is an exploded perspective view of a connecting portion of a corner of a sheet fixing frame of the present invention;

FIG. 6 is a cross-sectional view illustrating an installation state of a sheet fixing frame of the present invention;

FIG. 7 is an exploded cross-sectional view illustrating an installation process of a sheet fixing frame of the present invention;

FIG. 8 to FIG. 11 are cross-sectional views illustrating an installation process of a sheet fixing frame of the present invention;

FIG. 12 is an excerpt perspective view of a fixing frame according to a second exemplary embodiment of the present invention;

FIG. 13 is a perspective view illustrating a function of a fixing frame according to a second exemplary embodiment of the present invention;

FIG. 14 is a cross-sectional view of a sheet fixing frame according to a third exemplary embodiment of the present invention; and FIG. 15 is a cross-sectional view of a sheet fixing frame according to a fourth exemplary embodiment of the present invention.

DETAILED DESCRIPTION OF THE INVENTION

In various exemplary embodiments, configurative elements having the same configurations are explained in the first exemplary embodiment using the same reference numerals, while in the other exemplary embodiments, configurative elements different from those of the first exemplary embodiments are explained.

Hereinbelow is detailed explanation on a sheet fixing frame according to a first exemplary embodiment of the present invention with reference to the views attached hereto.

Of the attached views, FIG. 2 is a perspective view of a sheet fixing frame of the present invention, FIG. 3 is an exploded perspective view of a sheet fixing frame of the present invention, FIG. 4 is a perspective view of a connecting portion of a corner of a sheet fixing frame of the present invention, and FIG. 5 is an exploded perspective view of a connecting portion of a corner of a sheet fixing frame of the present invention.

As illustrated in the aforementioned view, a sheet fixing frame of the present invention is installed onto a periphery of an installation subject area A so as to secure an end of a cover sheet 20 which finishes the installation subject area A where light source A is placed. The sheet fixing frame includes a fixing frame 110 to which an end of the cover sheet 20 is coupled, a fastening member 120 which secures the fixing frame 110 to the installation subject area A, and a supporting member 130 which is coupled to the fixing frame 110 and supports the cover sheet 20.

Herein, the cover sheet 20 is made of material having transparency and stretchability so as to penetrate light provided from light source, and more particularly a sheet made of polyvinyl chloride material may be applied thereto. In addition, on each periphery end of the cover sheet 20, a fastening device 21 which is secured to the fixing frame 110 in a detachable manner is secured by means of an adhesive or ultrasonic welding.

The fixing frame 110 is placed on the periphery of the installation subject area A, and forms a fixing plate 111 which contacts a front surface facing an opening of the installation subject area A, a fixing hook 112 which is extended towards a direction perpendicular to the fixing plate 111 at one end of the fixing plate 111 and to which the cover sheet 20 is coupled, and a supporting plate 111 which is formed parallel to the fixing hook 112 at another end of the fixing plate 111 forming a receiving space in the inner side while forming a square cross section having an open lower portion, wherein the receiving space is predetermined to have a width to which a head 121 of the fastening member 120 may be inserted, and a depth to enable smooth detachment of the fastening device 21 with the head 121 of the fastening member 120 received.

In addition, in an inner surface of the fixing hook 112 and the supporting plate 113, a guide 114 is formed to protrude in a predetermined distance from the fixing plate 111, while in the supporting plate 113, a first concave groove 113*a* is formed to engage a first bump 132*a* of a supporting member 130 to be explained hereinbelow.

Meanwhile, the front surface facing the opening of the installation subject area A may be a surface of the installation subject area A shown through the opening, or a surface of an additional angle frame F which is installed onto a side surface of the installation subject area A in order to adjust a finishing location of the cover sheet 20 from the installation subject area A as illustrated in the figures.

The front end of the fastening member 120 penetrates the fixing plate 111 and is secured to the installation subject area A, whereas the rear end of the fastening member 120 has a head 121. The fastening member 120 may be embodied as a screw.

The supporting member 130 has, at its one end, a coupling 131 which is coupled to the fixing frame, and at its another end, a supporter 133 which supports the cover sheet 20. On the coupling 131, a coupling groove 132 to which the supporting plate 113 of the fixing frame 110 is inserted is formed, and on the inner surface of the coupling groove 132, a first bump 132*a* which engages a first concave groove 113*a* of the supporting plate 113 is formed. On one side surface of the lower end of the supporter 133, a supporting surface 133*a* which supports the cover sheet 20 is formed, and on an opposite site of the supporting surface 133*a*, a dent 133*b* is formed.

On the coupling 131, a dividing wall 138 is formed on a surface which faces the receiving space. Such a dividing wall 138 divides the receiving space into a first space a1 where the fastening device 21 is received and a second space a2 where the head 121 of the fastening member 120 is placed, to limit an insertion depth of the fastening device 21.

The supporting member 130 is made of transparent material, and more desirably light diffusion material so that light from light source L towards a side portion of the cover sheet 20 which is supported by the supporting member 130 may pass through, and more desirably, polycarbonate resin having predetermined softness so as to prevent the cover sheet 20 from being torn apart.

Meanwhile, the fixing frame 110 is made of a linear length member having the aforementioned cross-sectional structure, and is installed onto the periphery of the installation subject area A. Herein, in a case where the periphery of the installation subject area A has a square shape, each end of the fixing frame 110 is cut by 45°, and ends of a pair of fixing frames 110 placed adjacently are placed to meet each other. The connection state of the ends of the pair of fixing frames 110 placed adjacently is maintained by a connecting bridge 140.

The connecting bridge 140 connects the ends of the pair of fixing frames 110 placed adjacently, its central portion is formed in a bent manner by an angle corresponding to the angle between the pair of fixing frames 110 placed adjacently, and an insertion end 141 which is inserted between the fixing plate 111 of the pair of fixing frames 110 and the guide 114 is formed on both ends of the connecting bridge 140.

Meanwhile, it would also be possible to cut the ends of the supporting member 130 by 45° as the fixing frame and place them to meet each other, or place a connection supporter 150 which consists of the same cross section as the supporting member 130 and which has a center bent by 90° between the supporting member 130 to support the cover sheet 20.

Such a connection supporter 150 consists of the same material and cross-section as the supporting member 130, and has on each end a coupling 151 where a coupling groove 152 and a first bump 152*a* are formed, and a supporter 153 where a dent 153*b* and a support surface 153*a* are formed; and further, a central portion of the connection supporter 150 is formed in a bent manner by an angle corresponding to the angle between the pair of fixing frames 110. In addition, the connection supporter 150 has on its central bent portion a cut groove 158 which separates the coupling 151 of both ends.

Hereinbelow is explanation on an operation of the aforementioned sheet fixing frame according to a first exemplary embodiment of the present invention.

Of among the attached views, FIG. 6 is a cross-sectional view illustrating an installation state of a sheet fixing frame of the present invention.

As in FIG. 6, in a state where an angle frame F for securing the fixing frame 110 is installed onto each side of the installation subject area A, the fixing frame 110 is installed onto the front surface of the angle frame F by a fastening member 120 such as a screw, and on the supporting plate 113 of the fixing frame 110, a supporting member 130 is assembled.

Next, when the fastening device 21 provided on an end of the cover sheet 20 is inserted between the supporting member 130 and the fixing hook 112, one side of the fastening device 21 is contacted to the supporting member 130, and the other side is coupled to the fixing hook 112.

When the fastening device 21 formed on both ends of the cover sheet 20 is each secured onto the fixing frame 110 placed on both ends of the installation subject area A in a state where the cover sheet 20 is stretched out tautly, the installation subject area A is finished by the cover sheet 20.

Light provided from light source L provided in the installation subject area A penetrates the cover sheet 20 made of transparent material and is provided as illuminating light.

Especially, the supporting member 130 which is coupled to the fixing frame 110 and supports the cover sheet 20 is made of light diffusion material to penetrate light, thereby enabling provision of illumination light through the cover sheet 20 placed on the side between the supporting member 130 and the fastening device 21 as well. Therefore, it becomes not only possible to obtain additional volume of light, but also prevent the portion where the fastening device 21 is inserted (hereinafter referred to as 'light joint strip') from showing as a dark line, thereby providing a new visual effect different from that of surface illuminant light according to prior art.

Especially, the cover sheet 20 portion which is located between the supporting member 130 and the fastening device 21 to form a side is supported by the support surface 133*a* formed on one side of the lower end of the supporter, thereby preventing the cover sheet 20 which is supported by the supporting member 130 from being easily torn apart. In addition, the dent 133*b* located opposite to the support surface 133*a* enables the illumination light which penetrates the top end and low end of the supporter 133 towards the support surface 133*a* to penetrate and diffuse under a uniform condition, thereby providing uniform light in the side portion.

Furthermore, as the coupling groove 132 is coupled to the supporting plate 113, the supporting member 130 is coupled to the fixing frame 110 in a detachable manner. Herein, on the coupling surface of the supporting plate 113 and the coupling groove 132, a first concave groove 113*a* and a first bump 132*a* are formed respectively, which engages each other in the process where the supporting plate 113 is inserted into the coupling groove 132, thereby preventing the supporting member 130 from being arbitrarily separated from the fixing frame 110.

In addition, since the fastening member 120 secures the fixing frame 110 to the installation subject area A as it penetrates the fixing plate 111 provided between the fixing hook 112 and the supporting plate 113 of the fixing frame 110 and is coupled to the angle frame F, an angle frame F corresponding to the width of the fixing frame 110 may be applied. In addition, the area hidden by the illumination light provided from the light source L by the angle frame F or the fixing frame 110 is reduced compared to that of prior art, and thus the volume of light towards the cover sheet 20 is reduced.

Especially, since the compression load applied to the supporting plate 113 and the tensile load applied to the fixing hook 112 is each dispersively supported to each of both ends of the fixing plate 111, it is possible to prevent load being concentrated on one area of the fixing frame 110 as in the prior art. Furthermore, since the fixation power of the fixing plate 111 applies between the supporting plate 113 and the fixing hook 112, it is possible to obtain a stable fixation power.

In addition, in the process of expanding and forming receiving space provided between the fixing hook 112 and the supporting plate 113 to enable insertion of the fastening member 120 into the receiving space and assembling the supporting member 130 to the fixing frame 110, it is possible to have the width of the receiving space reduced by the supporting member 130, to maintain an optimal space for coupling of the fastening device 21.

Furthermore, it is possible to minimize the area that the fixing frame 110 occupies within the installation subject area A, thereby enabling a finishing construction using the cover sheet 20 even in a space with narrow width.

In addition, by the dividing wall 138, the receiving space is divided into the first space a1 where the fastening device 21 is received and the second space a2 where the head 121 of the fastening member 120 is placed. Therefore, as the depth of the receiving space expanded and formed for receiving the fastening member 120 is reduced, the insertion depth of the fastening device 21 is limited to the first space a1, and thus preventing the front end of the fastening device 21 from being inserted into the second space a2 where the head 121 of the fastening member 120 is placed.

Meanwhile, it has been explained in the present exemplary embodiment that the installation subject area A consists of a concave space and that an angle frame F for installing the fixing frame 110 is installed onto a side of the concave space, but the angle frame F is provided for predetermining the position for securing the fixing frame 110, and thus in a case where the depth of the concave space is not deep, it would be possible to fixate and install the fixing frame 110 directly onto the front surface of the installation subject area A.

A process of installing a sheet fixing frame of the present invention is explained hereinbelow with reference to FIGS. 7 to 10.

As illustrated in FIG. 7, the fixing frame 110 is secured to the front surface of the angle frame F by the fastening of the front end of the fastening member 120 being inserted into the receiving space formed between the fixing hook 112 and the support plate 113 penetrating the fixing plate 111 and being fastened to the angle frame F, and the head 121 formed in the rear end of the fastening member 120 being positioned between the fixing plate 11 and the guide 114.

Next, as illustrated in FIG. 8, the supporting member 130 is assembled by fitting the coupling groove 132 of the supporting member 130 to the supporting plate 113 of the fixing frame 110. Herein, as the first bump 132*a* within the coupling groove 132 engages with the first concave groove 113*a* of the supporting plate 113, the coupling groove 132 of the supporting member 130 is prevented from being arbitrarily separated from the supporting plate 113.

Next, as illustrated in FIG. 9, when the fastening device 21 fastened to the end of the cover sheet 20 is inserted into the first space a1 located between the fixing hook 112 and the supporting plate 113 of the fixing frame 110, the front end of the fastening device 21 contacts the inner surface of the supporting member 130 and one side of the rear end is secured to the inner end of the fixing hook 112 as it is placed in an inclined manner from the front end, as illustrated in FIG. 10. As aforementioned, in a state where the fastening device 21 is secured to the fixing frame 110, a tensile power of the cover sheet 20 is applied to the other side of the rear end of the fastening device 21, and thus the fastening device 21 is prevented from being arbitrarily separated from the fixing hook 112.

In addition, since the dividing wall 138 physically divides the space into the first space a1 where the fastening device 21 is inserted and the second space a2 where the head of the fastening member 120 is placed, the insertion depth of the fastening device 21 is limited, thereby maintaining the location of insertion of the fastening device 21.

Meanwhile, the connecting portion of the pair of fixing frames 110 is explained hereinbelow with reference to FIGS. 4 and 5.

First of all, as in FIG. 4, each end of the pair of fixing frames 10 placed adjacent to each other is cut by 45° and meets each other to connect the corner portion, and as an insertion end formed on both ends of the connecting bridge 140 is inserted and secured between the fixing plate 111 and the guide 113, respectively, ends of the pair of the fixing frames 110 are connected to each other.

Herein, the width of the insertion end 141 of the connecting bridge 140 is formed so as to be inserted and secured between the fixing plate 111 and the guide 114 of the fixing frame 110, thereby not only making it possible to maintain the connected state of the pair of fixing frames 110 in the process of connecting the pair of fixing frame 110 using the connecting bridge 140, but also preventing generation of difference in the connecting portion of the fixing frame 110 at both sides.

In addition, as illustrated in FIG. 5, in the connecting portion of the corner of the pair of fixing frames 110, the cover sheet 20 of the support surface is supported by the connection supporter 150 which is made of the same material and cross-section as the supporting member 130, thereby preventing the cover sheet 20 from being damaged by the sharp corner portion of the fixing frame 110 which is made of metal material.

That is, the connection supporter 150 is made of the same material and cross-section as the supporting member 130, and the central portion is bent by an angle corresponding to the angle between the pair of fixing frames 110, and thus it is possible to enable the coupling groove 152 formed in the coupling 151 of the connection supporter 150 to be inserted into the supporting plate 113 of the fixing frame 110. Herein, of the external portion of the connection supporter 150, it is desirable that the portion which is directly contacted by the cover sheet 20 is formed in a curved surface having a predetermined curvature in order to prevent the cover sheet 20 from being torn apart.

The coupling structure and function of the connection supporter 150 and fixing frame 110 are the same as the coupling structure and function of the aforementioned supporting member 130 and the fixing frame 110, and thus detailed explanation thereof is omitted.

In addition, since it is difficult to construct the corner portion of the installation subject area to be have a precisely perpendicular angle due to the environmental conditions of construction site, it is also difficult for the angle between the pair of fixing frames installed in the support surface portion of the installation subject area to maintain a precise perpendicular angle. However, between the couplings 151 of both sides of the connection supporter 150, that is in the bent point of the central portion, a cut groove 158 is formed which separates the coupling 151 of both ends, and the couplings 151 of both ends can be deformed within the elasticity area which the material of the connection supporter 150 permits, and thus even if the angle between the pair of fixing frames is not exactly a perpendicular angle, it becomes possible to install the connecting support on the connecting portion of the fixing frame.

Of the attached views, FIG. 11 is a cross-sectional view of a sheet fixing frame according to a first exemplary embodiment of the present invention.

As illustrated in FIG. 11, in a case where the installation subject area A has a large area and thus it is impossible to finish the installation subject area A with one piece of cover sheet 20, it is possible to configure such that a fastening device 21 is inserted into and secured to each end of the fixing frame 110*a*. That is, it is possible to form the fixing hook 112 and the supporting plate 113 of the fixing frame 110*a* to be symmetric to each other based on the fixing hook 112 and form two receiving spaces in one fixing frame 110 and place them on the cover sheet 20 and the connecting portion of the cover sheet 20.

As such, in a case of forming two receiving spaces in one fixing frame 110*a* and having one pair of fastening device 21 of the cover sheet 20 placed adjacently to be secured together, it is possible to minimize the width of the joint strip which is placed between the cover sheet 20, and improve the convenience of construction.

Of the attached views, FIG. 12 is an excerpt perspective view of a fixing frame according to a second exemplary embodiment of the present invention, and FIG. 13 is a perspective view illustrating functions of the fixing frame according to the second exemplary embodiment of the present invention.

As illustrated in FIG. 12, the fixing frame 110*b* according to the second exemplary embodiment is different from the aforementioned exemplary embodiment in that there are a plurality of slits 115 which cut the fixing plate 111 and the supporting plate 113 in a direction intersecting with the longitudinal direction of the fixing frame 110*b*. Other configurative elements besides such slits 115 are the same as the aforementioned exemplary embodiment, and thus detailed explanation on the same configurative elements are omitted.

In a case where a plurality of lists 115 are formed in the fixing frame 110*b*, when the fixing frame 110*b* is bent towards the supporting plate 113, the width of the slit 115 becomes narrow as in FIG. 13, whereas when the fixing frame 110*b* is bent towards the fixing hook 112, the width of the slit 115 is increased, enabling the fixing frame 110*b* to be bent along the plate surface of the fixing hook 112. Therefore, after the fixing frame 110*b* is installed on the installation subject area A in a curved shape, herein it becomes able to install the cover sheet 20.

Meanwhile, the supporting member 130 which is assembled to the supporting plate 113 of the fixing frame 110*b* is made of material having predetermined softness, and thus may be installed in a bent manner in accordance with the supporting plate 113, and since the cover sheet 20 is supported by such a supporting member 130, it becomes able to form smooth curves.

Of the attached views, FIG. 14 is a cross-sectional view of a sheet fixing frame according to a third exemplary embodiment of the present invention.

The sheet fixing frame according to the third exemplary embodiment of the present invention has an additional finishing plate 161 which is placed on an opening of the first space a1 where the fastening device 21 is inserted, and a finishing member 160 where an insertion plate 162 extended towards a direction perpendicular to the inner surface of the finishing plate 161. In addition, on the fixing hook 112 of the fixing frame 110, an insertion groove 116 to which the insertion plate 162 is coupled is formed, and on a coupling surface of the insertion plate 162 and insertion groove 116, a second concave groove 116*a* and a second bump 162*a* which engages each other are formed, respectively. Other configurative elements besides the fixing frame 110*c* and the finishing member 160 are same as those in the aforementioned exemplary embodiment, and thus detailed explanation thereof is omitted.

As aforementioned, the finishing member 160 maintains the state coupled to the fixing frame 110*c* as the insertion plate 162 of the finishing member 160 is inserted into the insertion groove 116 of the fixing frame 110*c*. Herein, since the finishing plate 161 of the finishing member 160 finishes the opening where the fastening device 21 is received, the fastening device 21 and the connecting portion of the fastening device 21 and cover sheet 20 are not exposed, improving the finishing quality of the product.

In addition, at the same time as the insertion plate 162 is coupled to the insertion groove 116 of the fixing frame 110*c* and is assembled, the second bump 162*a* of the insertion plate 162 engages the second concave groove 116*a* of the insertion groove 116. Therefore, the finishing member 160 is prevented from being arbitrarily separated from the fixing frame 110*c*, in a state where it is assembled as aforementioned. In addition, in a state where the insertion plate 162 of the finishing member 160 is coupled to the insertion groove 116 of the fixing frame 110*c*, the fastening device 21 pressurizes the fixing hook 112 to compress the insertion groove 116, thereby preventing the finishing member 160 from being dislocated arbitrarily from the fixing frame 110.

Meanwhile, also in a case where the fastening device 21 is secured to both ends of the fixing frame 110*d* as illustrated in FIG. 15, it is also possible to form an insertion groove 116 between the fixing hook 112 at both ends and have the insertion plate 162 of the finishing member 160 to be coupled to the insertion groove 116, thereby enabling the finishing plate 161 of the finishing member 160 to finish the opening of the first space a1 where the fastening device 21 is received.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A sheet fixing frame which is installed on a periphery of an installation subject and secures an end of a cover sheet for finishing an installation subject area, the sheet fixing frame comprising:

a fixing frame which has a fixing plate contacting the installation subject area, a fixing hook which is bent in one end of the fixing plate and to which the end of the cover sheet is coupled, and a supporting plate which is extended from another end of the fixing plate and is parallel to the fixing hook so as to provide a receiving space between the fixing hook and the supporting plate, wherein a width of the receiving space between the fixing hook and the supporting plate is formed such that a fastening member can be inserted therein, wherein the supporting plate supports the cover sheet, wherein the fixing frame is placed on the periphery of the installation subject area;

the fastening member penetrates the fixing plate between the fixing hook and the supporting plate and is fastened to the installation subject area;

a supporting member which has a coupling to which the supporting plate of the fixing frame is inserted at one end of the supporting member, and a supporter which supports the cover sheet at another end of the supporting member; and a fastening device which is provided at the end of the cover sheet, wherein the fastening device is inserted into a space between the supporting plate and the fixing hook and is secured to the fixing hook in e detachable manner.

2. The sheet fixing frame according to claim 1, wherein the supporting member is formed to protrude from a side of the coupling facing the receiving space, and comprises a dividing wall which divides the receiving space into a first space where the fastening device is placed and a second space where a head of the fastening member is placed.

3. The sheet fixing frame according to claim 2, wherein a first bump and a first concave groove which engages each other are formed on a coupling surface of the supporting plate of the fixing frame and the coupling of the supporting member, respectively.

4. The sheet fixing frame according to claim 1, wherein light source is installed on the installation subject surface, and the cover sheet and the supporting member are made of transparent material.

5. The sheet fixing frame according to claim 4, wherein the supporting member has, in a lower end of the supporter which faces the fixing hook, a supporting surface which supports the cover sheet at one side, and a dent at another side of the lower end.

6. The sheet fixing frame according to claim 1, wherein a plurality of slits which cut the fixing plate and the supporting plate are formed in a direction intersecting with a longitudinal direction.

7. A sheet fixing frame which is installed on a periphery of an installation subject and secures an end of a cover sheet far finishing an installation subject area, the sheet fixing frame comprising:

a fixing frame which has a fixing late contacting the installation subject area, a fixing hook which is bent in one end of the fixing plate and to which an end of the cover sheet is coupled, and a supporting plate which is extended from another end of the fixing plate and is parallel to the fixing hook so as to provide a receiving space between the fixing hook and the supporting plate, wherein a width of the receiving space between the fixing hook and the supporting plate is formed such that the fastening member can be inserted therein, wherein the supporting plate supports the cover sheet, wherein the fixing frame is placed on the periphery of the installation subject area;

a fastening member which penetrates the fixing plate between the fixing hook and the supporting plate and is fastened to the installation subject area;

a supporting member which has a coupling at one end of the supporting member to which the supporting plate of the fixing frame is inserted and a supporter at another end of the supporting member which supports the cover sheet, wherein there are at least a pair of fixing frames of which each end is connected to be installed on the periphery of the installation subject area; and a connecting member of which both ends are respectively inserted into each end of the pair of fixing frames placed adjacently to connect the pair of fixing frames, wherein a guide which is distanced from the fixing plate in the receiving place between the fixing hook and the supporting plate and secures an end of the connecting member is formed in the fixing frame.

8. The sheet fixing frame according to claim 7, wherein the connecting member is placed on a connecting portion of a corner of the fixing frame, and has a central portion which is bent by an angle corresponding to an angle between the fixing frames of both sides.

9. A sheet fixing frame which is installed on a periphery of an installation subject and secures an end of a cover sheet for finishing an installation subject area, the sheet fixing frame comprising:

a fixing frame which has a fixing plate contacting the installation subject area, a fixing hook which is bent in one end of the fixing plate and to which the end of the cover sheet is coupled, and a supporting plate which is extended from another end of the fixing plate and is parallel to the fixing hook so as to provide a receiving space between the fixing hook and the supporting plate, wherein the supporting plate supports the cover sheet, wherein the fixing frame is placed on the periphery of the installation subject area;

a fastening member which penetrates the fixing plate between the fixing hook and the supporting plate and is fastened to the installation subject area;

a supporting member which has a coupling at one end of the supporting member to which the supporting plate of the fixing frame is inserted and a supporter at another end of the supporting member which supports the cover sheet; and a finishing member which is secured to the fixing frame so as to cover the receiving space where the fastening member is inserted, wherein the finishing member has a finishing plate which is placed on an opening and an insertion plate which is protruded from an inner surface of the finishing plate, wherein the fixing frame has an insertion groove where the insertion plate is secured to the fixing hook, wherein a concave groove and a bump are formed on a coupling surface of the insertion plate and the insertion groove, respectively.

* * * * *